US011691417B2

(12) United States Patent
Wong et al.

(10) Patent No.: US 11,691,417 B2
(45) Date of Patent: Jul. 4, 2023

(54) INKJET HEAD

(71) Applicant: TOSHIBA TEC KABUSHIKI KAISHA, Tokyo (JP)

(72) Inventors: Meng Fei Wong, Mishima Shizuoka (JP); Ryutaro Kusunoki, Mishima Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/357,897

(22) Filed: Jun. 24, 2021

(65) Prior Publication Data

US 2022/0184943 A1 Jun. 16, 2022

(30) Foreign Application Priority Data

Dec. 11, 2020 (JP) ..... 2020-206189

(51) Int. Cl.
*B41J 29/38* (2006.01)
*B41J 2/045* (2006.01)
*B41J 2/14* (2006.01)

(52) U.S. Cl.
CPC ..... *B41J 2/04591* (2013.01); *B41J 2/04541* (2013.01); *B41J 2/04581* (2013.01); *B41J 2/04588* (2013.01); *B41J 2/14233* (2013.01)

(58) Field of Classification Search
CPC ..... B41J 2/04595; B41J 2/04591
See application file for complete search history.

(56) References Cited

U.S. PATENT DOCUMENTS 6,231,151 B1 5/2001 Hotomi et al.
11,440,315 B2 * 9/2022 Mawatari ..... B41J 2/04595
2018/0086055 A1 3/2018 Takamura
2018/0099510 A1 4/2018 Niino
2021/0094290 A1 4/2021 Mawatari

FOREIGN PATENT DOCUMENTS

EP 3300888 A1 4/2018
EP 3508344 A1 7/2019
JP 2012-148479 A 8/2012
JP 2019-048458 A 3/2019

OTHER PUBLICATIONS

Extended European Search Report dated Jan. 14, 2022 in corresponding European Patent Application No. 21188985.2, 10 pages.

* cited by examiner

*Primary Examiner* — Lam S Nguyen
(74) *Attorney, Agent, or Firm* — Kim & Stewart LLP

(57) ABSTRACT

An inkjet head includes a pressure chamber storing ink, a nozzle communicating with the chamber, an actuator ejecting the ink through the nozzle by changing a volume of the chamber, and a circuit outputting a drive signal to the actuator with a drive waveform having a cycle based on a number of gradation levels being used for printing. When printing is performed using three or more gradation levels, the circuit outputs the signal that has a multi-drop drive waveform including two or more first waveforms for ejecting first to (n−1)-th droplets of the ink where n is equal to or greater than 3, a second waveform for ejecting an n-th droplet of the ink, and an intermediate time between the first waveform for ejecting the (n−1)-th droplet and the second waveform for ejecting the n-th droplet. The intermediate time is longer than a time between two adjacent first waveforms.

10 Claims, 11 Drawing Sheets

DRIVING CONDITION :
- NEGATIVE PRESSURE IN HEAD : -1.2kPa
- Ta : 2.06μs
- FREQUENCY : 5kHz
- INK : CIRCULATING 35℃

● FIRST DROP

▲ SECOND DROP + SATELLITE DROP

DRIVING CONDITION :
- AL : 1.86μs
- FREQUENCY : 1kHz
- IMAGING TIMING : 200μs

DRIVING CONDITION :

- NEGATIVE PRESSURE IN HEAD : -1.2kPa
- Ta : 2.06μs
- FREQUENCY : 5kHz
- INK : CIRCULATING 35℃

INKJET HEAD

CROSS-REFERENCE TO RELATED APPLICATION

This application is based upon and claims the benefit of priority from Japanese Patent Application No. 2020-206189, filed Dec. 11, 2020, the entire contents of which are incorporated herein by reference.

FIELD

Embodiments described herein relate generally to an inkjet head and an inkjet printer incorporating an inkjet head.

BACKGROUND

There is a liquid ejection device, such as an inkjet head, that can be mounted on an inkjet printer. An inkjet printer forms an image on a recording medium, such as a sheet of paper, by ejecting ink droplets from an inkjet head. The inkjet head ejects the ink droplets from a nozzle which connects to an ink pressure chamber. The ink droplets are ejected by changing a volume of the ink pressure chamber using a piezoelectric actuator. The operation of the actuator is controlled by the input of a drive waveform to the actuator.

Immediately after the ejection, a tailing or tail portion of the ejected ink can remain physically connected to the ink still in the nozzle. This connected portion between ejected and un-ejected may be referred to as a liquid pillar in some instances. When the tail portion (or liquid pillar) is broken, a droplet different from the main, intended one may be generated. Such a droplet formed when the liquid pillar breaks is sometimes called a satellite droplet.

When ink is being ejected in rapid succession according to a multi-drop ejection method (e.g., such as when performing color gradation printing), the incident of liquid pillars increases. Although a multi-drop drive waveform is typically adjusted so that a trailing end of the liquid pillar will be tapered, it is difficult to completely eliminate satellite droplets. As the flight speed of the satellite droplets becomes slower, the satellite droplets may become stalled in the middle, causing deterioration of printing quality due to landing disorder.

DETAILED DESCRIPTION

Figure 1:
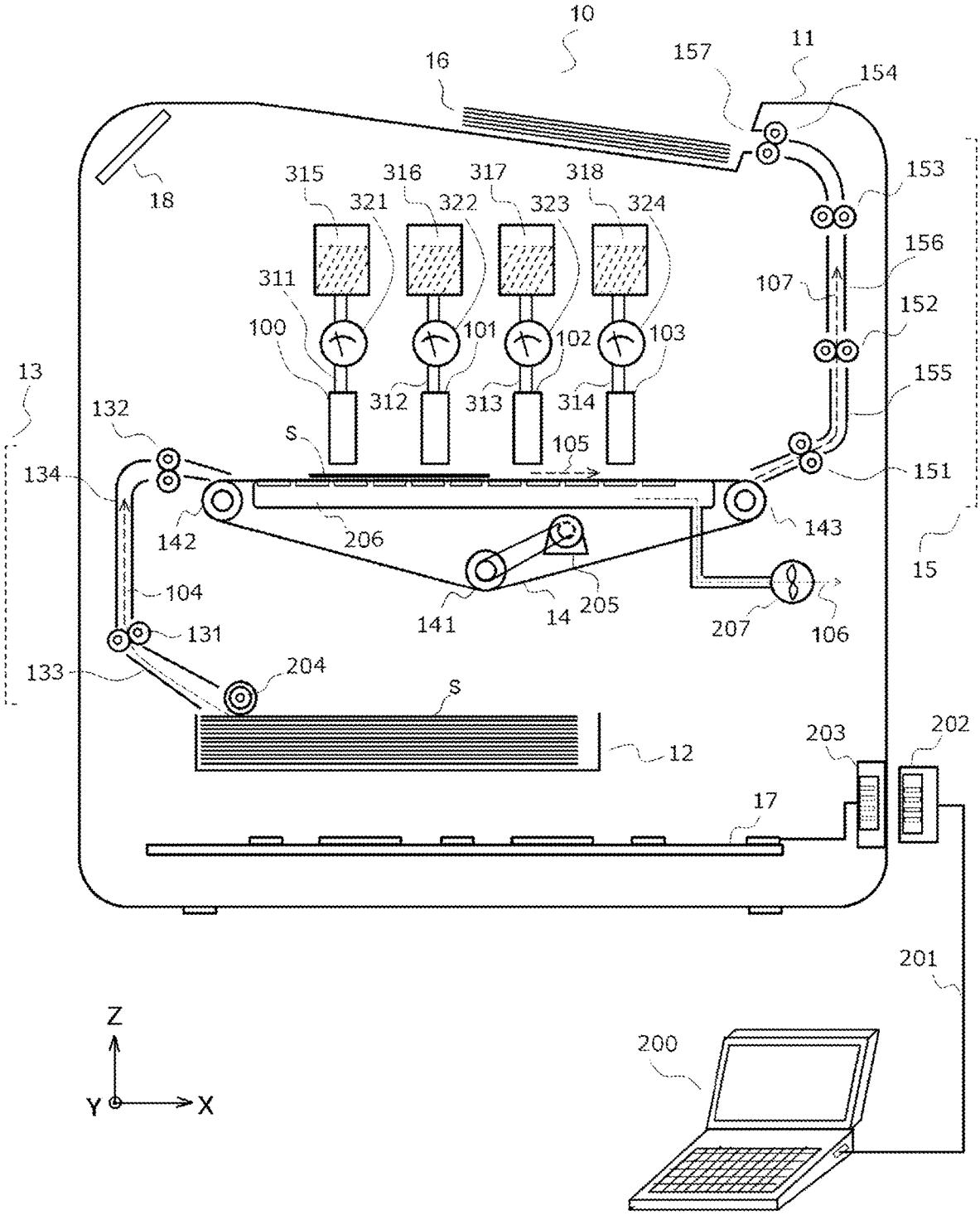
FIG. 1 is a schematic diagram of an inkjet printer including an inkjet head according to a first embodiment.

One or more embodiments provide an inkjet head capable of avoiding or reducing a deterioration in printing quality due to satellite ink droplets when ink is being ejected by a multi-drop method, for example, in gradation printing.

According to an embodiment, an inkjet head includes a pressure chamber that stores ink, a nozzle communicating with the pressure chamber, an actuator configured to eject the ink through the nozzle by changing a volume of the ink pressure chamber, and an actuator drive circuit configured to output, to the actuator, a drive signal that has a drive waveform having a predetermined cycle based on a number of gradation levels being used for printing. When printing is performed using three or more gradation levels, the drive circuit outputs the signal that has a multi-drop drive waveform including: two or more first waveforms for ejecting first to (n−1)-th droplets of the ink where n is equal to or greater than 3, a second waveform for ejecting an n-th droplet of the ink, and an intermediate time between the first waveform for ejecting the (n−1)-th droplet and the second waveform for ejecting the n-th droplet, the intermediate time being longer than a time between two of the first waveforms that are adjacent to each other.

Hereinafter, inkjet heads according to embodiments will be described in detail with reference to the attached drawings. In each figure, the same components are denoted by the same reference numerals.

First Embodiment

An inkjet printer 10 includes a plurality of inkjet heads 100 to 103 according to a first embodiment will be described. FIG. 1 illustrates a schematic diagram of the inkjet printer 10. In the inkjet printer 10, a cassette 12 for storing a recording medium such as a sheet S, an upstream conveyance path 13 for the sheet S, a conveying belt 14 for conveying the sheet S taken out from the cassette 12, the plurality of inkjet heads 100 to 103 that eject ink droplets toward the sheet S on the conveying belt 14, a downstream conveyance path 15 for the sheet S, a discharge tray 16, and a control board 17 are arranged inside a housing 11. The operation unit 18 which is a user interface is arranged on the upper side of the housing 11.

Image data to be printed on the sheet S is generated by, for example, a computer 200 which is an externally connected device. For example, the image data generated by the computer 200 is transmitted to the control board 17 of the inkjet printer 10 through a cable 201 and connectors 202 and 203.

A pickup roller 204 supplies the sheets S one by one from the cassette 12 to the upstream conveyance path 13. The upstream conveyance path 13 includes a pair of feed rollers 131 and 132 and sheet guide plates 133 and 134. The sheet S is conveyed to the upper surface of the conveying belt 14 through the upstream conveyance path 13. An arrow 104 in the figure indicates the conveyance direction of the sheet S from the cassette 12 toward the conveying belt 14.

The conveying belt 14 is a net-shaped endless belt having a large number of through holes formed on a surface thereof. A drive roller 141 and driven rollers 142 and 143 rotatably support the conveying belt 14. A motor 205 rotates the conveying belt 14 by rotating the drive roller 141. In the figure, an arrow 105 indicates a rotation direction of the conveying belt 14. A negative pressure container 206 is arranged on the back surface side of the conveying belt 14. The negative pressure container 206 is connected to a fan 207 for depressurizing. The fan 207 generates a negative pressure in the negative pressure container 206 by the air flow, which attracts and holds the sheet S on the upper surface of the conveying belt 14. In the figure, an arrow 106 indicates the direction of the air flow.

The inkjet heads 100 to 103 are arranged so as to face the sheet S attracted and held on the conveying belt 14 through a slight gap of, for example, 1 mm. The inkjet heads 100 to 103 eject ink droplets toward the sheet S. The inkjet heads 100 to 103 print an image when the sheet S passes below. Each of the inkjet heads 100 to 103 has the same structure except that the colors of the ejected inks are different. The colors of the ejected inks are, for example, cyan, magenta, yellow, and black.

The inkjet heads 100 to 103 are connected to ink tanks 315 to 318 and ink supply pressure adjusting devices 321 to 324 through the ink flow paths 311 to 314, respectively. The ink tanks 315 to 318 are arranged above the inkjet heads 100 to 103. During standby, to prevent ink from leaking from nozzles 24 (refer to FIG. 2) of the inkjet heads 100 to 103, each of the ink supply pressure adjusting devices 321 to 324 maintains the internal pressure of the corresponding inkjet head 100 to 103 negative, for example, −1.2 kPa with respect to the atmospheric pressure. At the time of image formation, the inks in the ink tanks 315 to 318 are supplied to the respective inkjet heads 100 to 103 by the ink supply pressure adjusting devices 321 to 324.

After the image formation, the sheet S is conveyed from the conveying belt 14 to the downstream conveyance path 15. The downstream conveyance path 15 includes pairs of feed rollers 151, 152, 153, and 154 and sheet guide plates 155 and 156 to form a conveyance path for the sheet S. The sheet S is discharged from a discharge port 157 to the discharge tray 16 through the downstream conveyance path 15. In the figure, an arrow 107 indicates a conveyance direction for the sheet S.

Subsequently, configurations of the inkjet heads 100 to 103 will be described. Although the inkjet head 100 is described below with reference to FIGS. 2 to 5, the inkjet heads 101 to 103 also have the same structure as the inkjet head 100.

Figure 2:
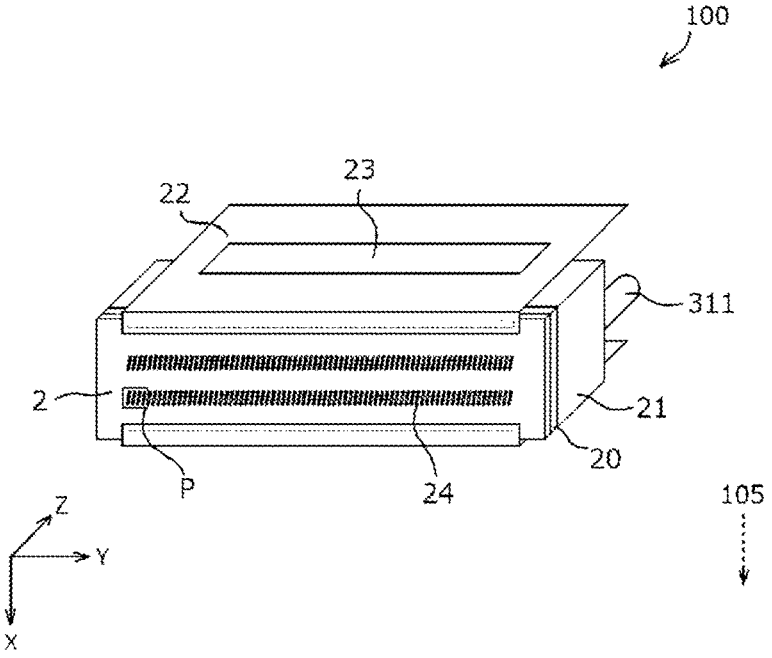
FIG. 2 is a perspective view of an inkjet head.

FIG. 2 is a perspective view of an exterior of the inkjet head 100. The inkjet head 100 includes a nozzle plate 2, a substrate 20, an ink supply unit 21, a flexible board 22, and a drive circuit 23. The plurality of nozzles 24 which eject the ink are formed in the nozzle plate 2. The ink ejected from each of the nozzles 24 is supplied from the ink supply unit 21. The ink flow path 311 from the ink supply pressure adjusting device 321 described above is connected to an upper side of the ink supply unit 21. The arrow 105 indicates the rotation direction (that is, the printing direction) of the conveying belt 14 that conveys the sheet S (refer to FIG. 1).

Figure 3:
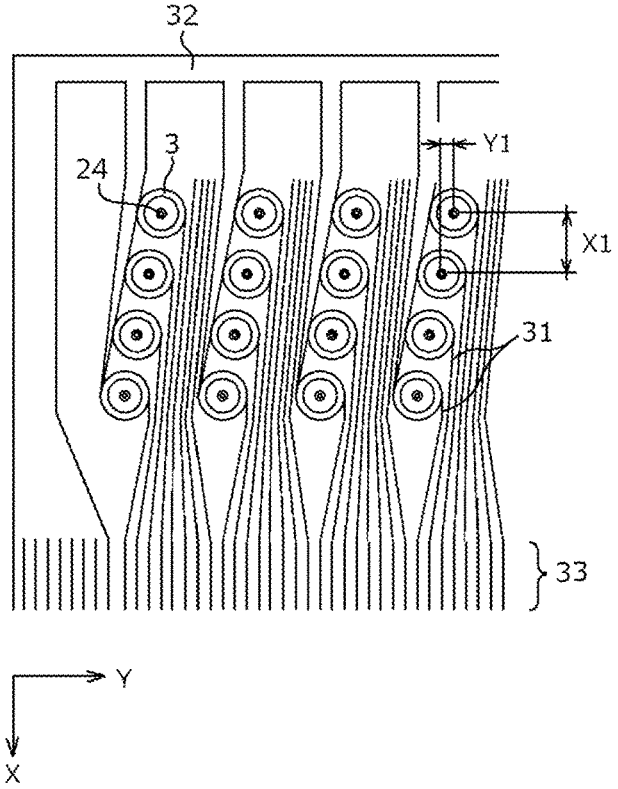
FIG. 3 is a plan view of a nozzle plate of an inkjet head.

FIG. 3 is an enlarged plan view of a portion surrounded by a broken line frame P in FIG. 2. The nozzles 24 are two-dimensionally arranged in the row direction (i.e., X-axis direction) and the column direction (i.e., Y-axis direction). However, the nozzles 24 are aligned obliquely with respect to the row direction so that the nozzles 24 do not overlap each other in the row direction. The nozzles 24 are arranged at intervals of a distance X1 in the X-axis direction and a distance Y1 in the Y-axis direction. As an example, the distance X1 is set to 338 μm, and the distance Y1 is set to 84.5 μm. That is, the distance Y1 is determined so that the recording density is 300 DPI in the Y-axis direction. Further, the distance X1 is determined based on the relationship between the rotation speed of the conveying belt 14 and the time required for the ink to land so as to perform printing at 300 DPI in the X-axis direction. With respect to the nozzles 24, a set of four nozzles 24 are arranged along the X-axis direction. Although not illustrated, for example, 75 sets of the nozzles 24 are arranged in the Y-axis direction as a group, and two groups thereof are arranged in the X-axis direction, so that 600 nozzles 24 are arranged in total (refer to FIG. 2).

An actuator 3 that is a drive source for ejecting the ink is provided for each nozzle 24. A set of the nozzle 24 and the actuator 3 makes up one channel. Each actuator 3 is formed in an annular shape and is arranged so that the nozzle 24 is located at the center thereof. For example, the inner diameter of the actuator 3 is 30 μm and the outer diameter is 140 μm. Each actuator 3 is electrically connected to an individual electrode 31. Furthermore, four actuators 3 aligned in the X-axis direction are electrically connected via a common electrode 32. The individual electrodes 31 and the common electrode 32 are further electrically connected to mounting pads 33. The mounting pad 33 is an input port through which a drive signal described later is input to each actuator 3. It is noted that, in FIG. 3, for the convenience of explanation, the actuator 3, the individual electrode 31, and the common electrode 32 are illustrated by solid lines, but these are provided inside the nozzle plate 2 (refer to the longitudinal sectional view of FIG. 4). Of course, the position of the actuator 3 is not limited to the inside of the nozzle plate 5.

The mounting pad 33 is electrically connected to the wiring pattern formed on the flexible board 22 through, for example, an anisotropic conductive film (ACF). Further, the wiring pattern of the flexible board 22 is electrically connected to the drive circuit 23. The drive circuit 23 is, for example, an integrated circuit (IC). The drive circuit 23 selects a channel for ejecting the ink according to the image data to be printed and outputs a drive signal to the actuator 3 of the selected channel.

Figure 4:
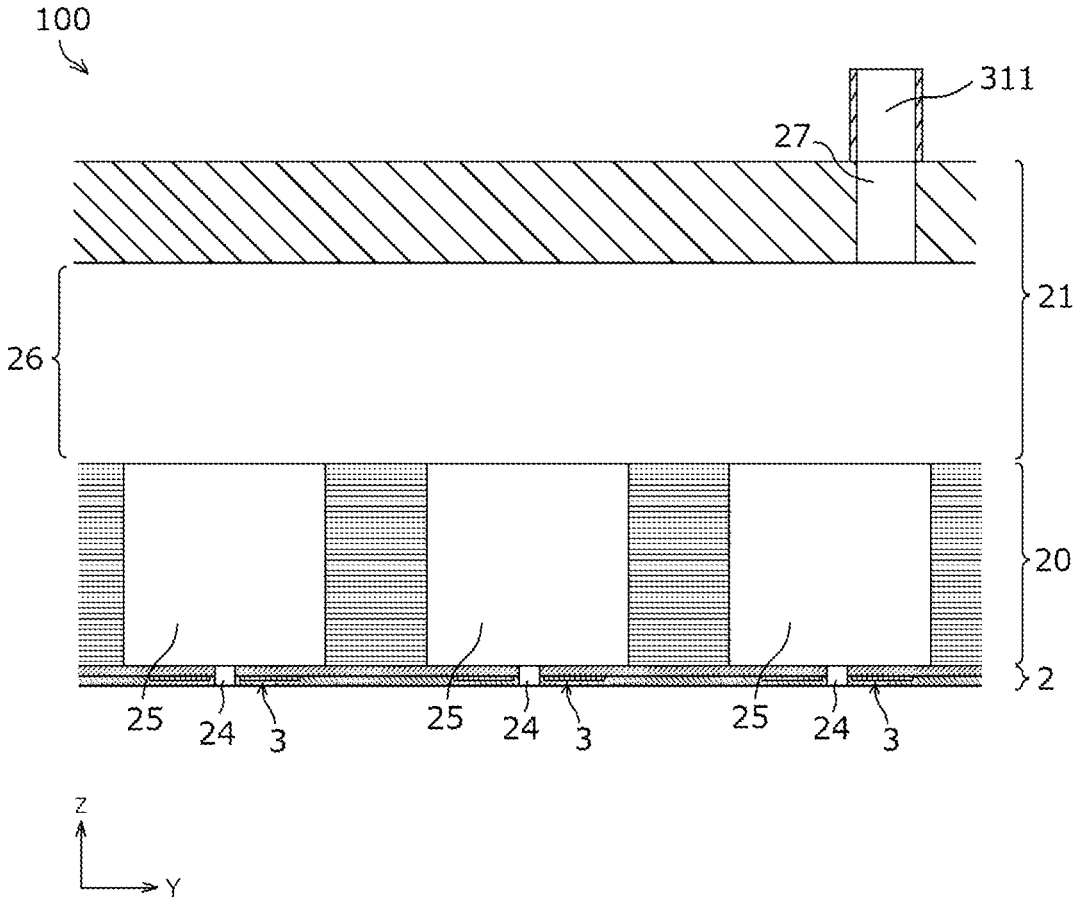
FIG. 4 is a cross-sectional view of an inkjet head.

FIG. 4 is a longitudinal cross-sectional view of the inkjet head 100. As illustrated in FIG. 4, the nozzles 24 penetrate the nozzle plate 2 in the Z-axis direction. The size of the nozzle 24 is, for example, 20 μm in diameter. An ink pressure chamber 25 which communicates with each nozzle 24 is provided inside the substrate 20. The ink pressure chamber 25 has, for example, a cylindrical shape with an upper portion thereof open. The upper portion of each ink pressure chamber 25 is open and communicates with a common ink chamber 26. The ink flow path 311 communicates with the common ink chamber 26 through an ink supply port 27. The ink pressure chamber 25 and the common ink chamber 26 are filled with the ink. In some cases, the common ink chamber 26 may be formed, for example, in a shape of a flow path for circulating the ink. The ink pressure chamber 25 has a configuration in which, for example, a cylindrical hole having a diameter of 200 μm is formed in the substrate 20 of a single crystal silicon wafer having a thickness of 400 μm. The ink supply unit 21 has a configuration in which a space corresponding to the common ink chamber 26 is formed of, for example, alumina ($Al_2O_3$).

Figure 5:
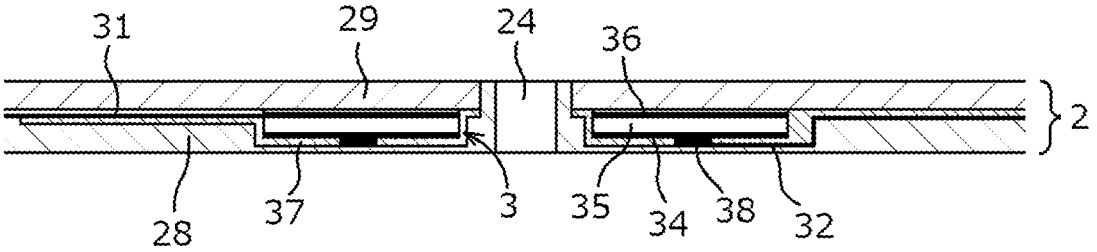
FIG. 5 is a cross-sectional view of a nozzle plate of an inkjet head.

FIG. 5 is a partially enlarged view of a longitudinal cross section of the nozzle plate 2. The nozzle plate 2 has a structure in which a protective layer 28, an actuator 3, and a vibrating plate (or diaphragm) 29 are stacked in this order from the bottom surface side. The actuator 3 has a structure in which an upper electrode 34, a thin plate-shaped piezoelectric body 35, and a lower electrode 36 are stacked. The lower electrode 36 is electrically connected to the individual electrode 31, and the upper electrode 34 is electrically connected to the common electrode 32. An insulating layer 37 for preventing a short circuit between the individual electrode 31 and the common electrode 32 is interposed in the boundary between the protective layer 28 and the vibrating plate 29. The insulating layer 37 is made of, for example, a silicon dioxide film ($SiO_2$) having a thickness of 0.5 μm. The upper electrode 34 and the common electrode 32 are electrically connected by a contact hole 38 formed in the insulating layer 37. The piezoelectric body 35 is made of, for example, PZT (lead zirconate titanate) having a thickness of 5 μm or less. The lower electrode 36 and the upper electrode 34 are made of, for example, platinum having a thickness of 0.1 μm. The individual electrode 31 and the common electrode 32 are formed of, for example, gold (Au) having a thickness of 0.3 μm.

The vibrating plate 29 is made of an insulating inorganic material. The insulating inorganic material is, for example, silicon dioxide ($SiO_2$). The thickness of the vibrating plate 29 is, for example, 2 to 10 μm, preferably 4 to 6 μm. As described in detail later, the vibrating plate 29 and the protective layer 28 are curved inward as the piezoelectric body 35 to which the voltage is applied is deformed in a $d_{31}$ mode. Then, when the application of the voltage to the piezoelectric body 35 is stopped, the piezoelectric body 35 returns to the original state. Due to this reversible deformation, the volume of the ink pressure chamber 25 expands and contracts. When the volume of the ink pressure chamber 25 is changed, the ink pressure inside the ink pressure chamber 25 is changed. The ink is ejected from the nozzle 24 by utilizing the expansion and contraction of the volume of the ink pressure chamber 25 and the change in the ink pressure. That is, the nozzle 24, the actuator 3, and the ink pressure chamber 25 make up an ink ejection unit of the inkjet head 100.

The protective layer 28 is made of, for example, a polyimide having a thickness of 4 μm. The protective layer covers one surface on the bottom surface side of the nozzle plate 2 facing the sheet S and further covers an inner peripheral surface of the nozzle 24.

Figure 6:
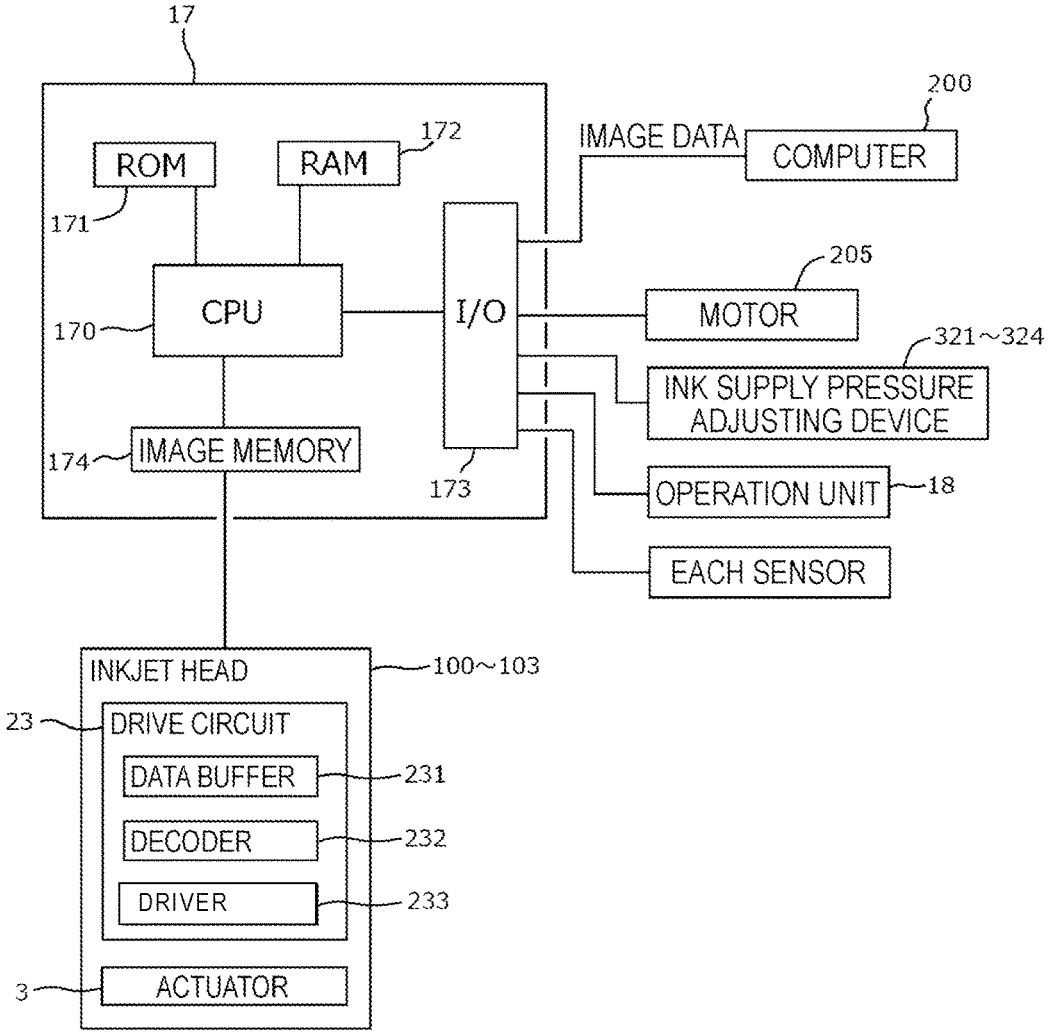
FIG. 6 is a block diagram of a control system of an inkjet printer.

FIG. 6 is a block diagram of a control system of the inkjet printer 10. The control board 17 includes a CPU (central processing unit) 170, a ROM (read only memory) 171, a RAM (random access memory) 172, an I/O (input/output) port 173, and an image memory 174. The CPU 170 controls the motor 205, the ink supply pressure adjusting devices 321 to 324, the operation unit 18, and various sensors through the I/O port 173. The image data from the computer 200, which is an externally connected device, is transmitted to the control board 17 through the I/O port 173 and stored in the image memory 174. The CPU 170 causes the image data stored in the image memory 174 to be processed by the drive circuits 23 of the inkjet heads 100 to 103 in the order of drawing. The data to be output includes gradation data that designates the gradation of dots based on the image data.

The drive circuit 23 includes a data buffer 231, a decoder 232, and a driver 233. The data buffer 231 stores the image data in chronological order for each actuator 3. The decoder 232 controls the driver 233 for each actuator 3 based on the image data stored in the data buffer 231. The driver 233 outputs a drive signal for operating each actuator 3 according to the control of the decoder 232. The drive signal is a voltage applied to the actuator 3 having a particular waveform. That is, the drive circuit 23 has a function as an actuator drive circuit that applies the drive signal to the actuator 3.

Figure 7:
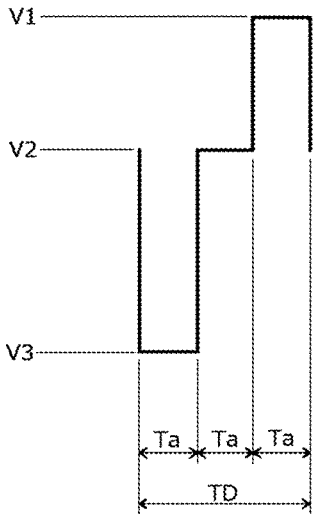
FIG. 7 illustrates a waveform of a drive signal to be input to an actuator of an inkjet head.

Subsequently, the waveform of the drive signal for driving the actuator 3 will be described with reference to FIG. 7. FIG. 7 illustrates a basic drive waveform with which ink is ejected once. The basic drive waveform is referred to as a pulling drive waveform. When a dot is formed by this one-drop ejection, the actuator 3 is driven by a signal having only a basic drive waveform. When printing with two or more gradations with which dots are formed by ejecting ink two or more times, the actuator 3 is driven by a signal having a multi-drop drive waveform based on the basic drive waveform. A detailed description of the multi-drop drive waveform will be described later.

As illustrated in FIG. 7, in the basic drive waveform, a voltage V2 is applied to the actuator 3 as a bias voltage. That is, the voltage V2 is applied to the lower electrode 36 of the actuator 3 through the individual electrodes 31. The common electrode 32 connected to the upper electrode 34 of the actuator 3 is set to 0 V. Then, a voltage V3 as an expansion pulse is applied to the actuator 3 for a time Ta through the individual electrode 31, and after that, the voltage V2 as a contraction pulse for ejecting the ink is applied to the actuator 3 for the time Ta through the individual electrode 31. Subsequently, a voltage V1 as a contraction pulse for attenuating residual vibration is applied to the actuator 3 for the time Ta through the individual electrode 31. After that, the voltage V2 as the bias voltage is applied to the actuator 3, again. The magnitudes of the voltages V1 to V3 satisfy V1>V2>V3. As an example, the voltage V1 is 24 V, the voltage V2 is 15 V, and the voltage V3 is 0 V. During a series of operations, the voltage of the common electrode 32 is set to be constant at 0 V.

Each pulse width (that is, the time Ta) is preferably set to AL (Acoustic Length). The AL is a half period of a characteristic vibration period λ determined by the feature of the ink and the structure inside the head. In a case where the time Ta is AL, a time TD of the basic drive waveform is 3AL. The characteristic vibration period λ can be measured by detecting a change in impedance of the actuator 3 in a state of being filled with the ink. For example, an impedance analyzer is used for detecting the impedance. Another method for measuring the characteristic vibration period λ is to measure the vibration of the actuator 3 with a laser Doppler vibrometer when an electric signal having a step waveform or the like is input from the drive circuit 23 to the actuator 3. In addition, the characteristic vibration period may be obtained by calculation based on a simulation using a computer. The time Ta of each pulse width may be a multiple of AL or may be shorter than AL. Furthermore, the times Ta of the pulse widths may be different from each other. In addition, the basic drive waveform is not limited to a pulling waveform but may be a pushing waveform or a pushing-and-pulling waveform.

Figure 8A:
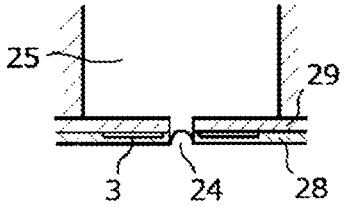
FIG. 8A through FIG. 8F are explanatory diagrams illustrating aspects of an operation of an actuator.
Figure 8B:
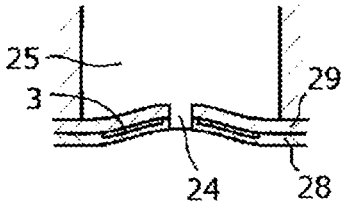

FIGS. 8A to 8F schematically illustrate an ink ejection operation when the actuator 3 is driven by a signal having the basic drive waveform of FIG. 7. When the bias voltage V2 is applied in the standby state, an electric field is generated in the thickness direction of the piezoelectric body 35, and as illustrated in FIG. 8B, the piezoelectric body 35 is deformed in the $d_{31}$ mode. Specifically, the annular piezoelectric body 35 is extended in the thickness direction and contracted in the radial direction. Due to the deformation of the piezoelectric body 35, bending stress is generated in the vibrating plate 29, and the actuator 3 is curved inward. That is, the actuator 3 is deformed so as to form a depression centered on the nozzle 24, and the volume of the ink pressure chamber 25 is contracted.

Figure 8C:
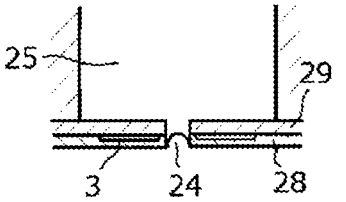

Subsequently, when the voltage V3 of the expansion pulse is applied for the time Ta, the actuator 3 returns to the state before deformation as schematically illustrated in FIG. 8C. At this time, in the ink pressure chamber 25, the internal ink pressure initially decreases as the volume expands to the original state, but following the subsequent flow of the ink from the common ink chamber 26 into the ink pressure chamber 25, the ink pressure increases. After the ink pressure chamber 25 is filled, the increase in ink pressure stops. That is, the ink pressure chamber 25 is in a pulling state.

Figure 8D:
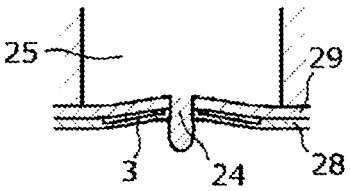
Figure 8E:
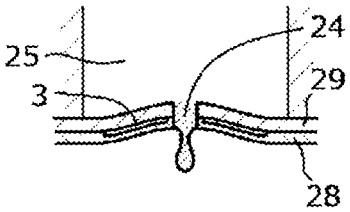
Figure 8F:
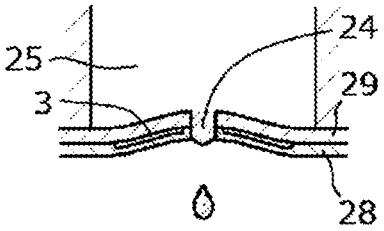

Subsequently, when the voltage V2 of the contraction pulse is applied for the time Ta, the piezoelectric body 35 of the actuator 3 is deformed again, and the volume of the ink pressure chamber 25 is contracted. The ink pressure in the ink pressure chamber 25 is thus increasing, and by further contracting the volume of the ink pressure chamber to increase the ink pressure, as schematically illustrated in FIG. 8D, the ink is pushed out from the nozzle 24. The application of the voltage V2 continues for the time Ta, and the ink is ejected from the nozzle 24 as schematically illustrated in FIG. 8E. Immediately after this ejection, tail portions of the ink droplets remain connected to the ink in the nozzle 24. Subsequently, the voltage V1 as a cancel pulse is applied for the time Ta. That is, when the ink is ejected, the ink pressure in the ink pressure chamber 25 is decreased, and the vibration of the ink remains in the ink pressure chamber 25. Therefore, the cancel pulse is applied to the actuator 3 to contract the volume of the ink pressure chamber 25, so that the residual vibration is attenuated. As illustrated schematically in FIG. 8F, the ink droplets are released as free flying droplets when the tail portions thereof are disconnected from the ink in the nozzle 24. However, at this time, satellite droplets may be generated by the disconnection of the tail portion from the ink still in the nozzle 24.

Figure 9:
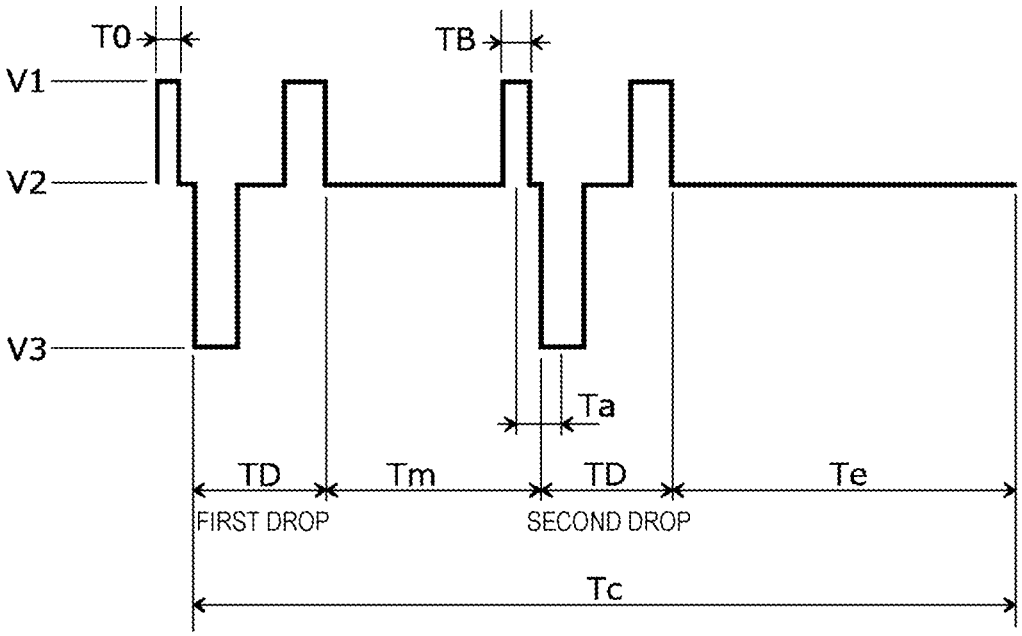
FIG. 9 illustrates a waveform of a multi-drop drive signal (n=2) to be input to an actuator.
Figure 10:
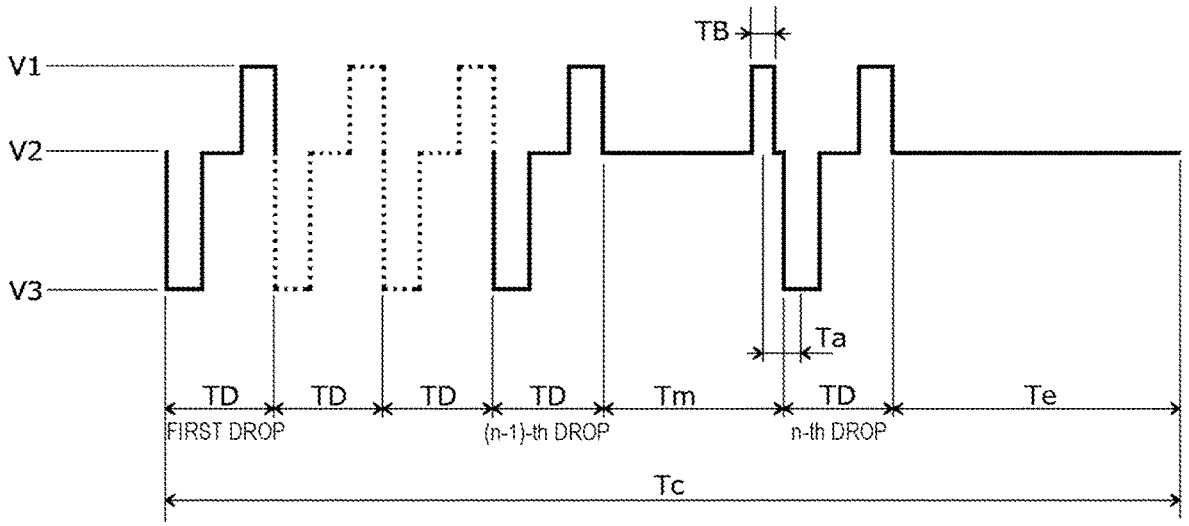
FIG. 10 illustrates a waveform of a multi-drop drive signal (n 3) to be input to an actuator.

FIGS. 9 and 10 illustrate an example of a multi-drop drive waveform of a signal for forming one dot by ejecting ink n times (n is an integer of 2 or more) within one drive cycle Tc. The frequency of the drive cycle Tc is, for example, 5 kHz. A signal having the multi-drop drive waveform (n=2) of FIG. 9 is input to the actuator 3 when printing with two gradations is performed by dropping the ink twice. A signal having the multi-drop drive waveform (n≥3) of FIG. 10 is input to the actuator 3 when printing with three or more gradations is performed by dropping the ink three times or more. The number of times of ejection within the drive cycle Tc is preferably 2 to 8 times (n=2 to 8), but the value or more may be used. The waveform data of each multi-drop drive waveform is stored in, for example, a memory in the drive circuit 23. The multi-drop drive waveform is selected by the IC of the drive circuit 23 based on the gradation data transmitted from the control board 17 described above.

The multi-drop drive waveform (n=2) of FIG. 9 with which printing with two gradations is performed includes two basic drive waveforms arranged in the drive cycle Tc of one cycle. At this time, an intermediate time Tm is provided between the drive waveform of the first drop and the drive waveform of the second drop. The intermediate time Tm is, for example, 4AL or more. The intermediate time Tm is preferably 4AL to 8AL and is more preferably an even multiple of AL. Furthermore, immediately before the drive waveform of the second drop, a boost pulse for increasing the ejection speed of the ink of the second drop is provided. In the drive waveform of the boost pulse, the voltage V1 is applied to the actuator 3 for a time TB. The pulse width (that is, the time TB) of the boost pulse is set to, for example, 0.2Ta to 0.5Ta. In a case where the time Ta is AL, the time TB is 0.2AL to 0.5AL. In the boost pulse, the interval between the midpoint (i.e., a half of the time TB) of the pulse width and the midpoint (i.e., a half of the time Ta) of the pulse width of the expansion pulse of the second drop is set to the time Ta. In a case where the intermediate time Tm is set to, for example, 4AL to 8AL, it is preferable that the ejection speed of the ink of the second drop is, for example, 1.01 to 1.20 times the ejection speed of the ink of the first drop.

It is noted that, in the example of FIG. 9, the boost pulse is provided immediately before the drive waveform of the first drop. In the drive waveform of the boost pulse, the voltage V1 is applied to the actuator 3 for a time T0 in the standby state before the drive cycle Tc starts. The pulse width of the boost pulse (that is, the time T0) is set to, for example, 0.15Ta. When the time Ta is AL, the time T0 is 0.15AL. Since the ejection speed of the ink of the first drop is not sufficient in the first cycle of the drive cycle Tc, the boost pulse for the first drop is provided to increase the ejection speed. It is noted that, if the ejection speed of the first drop of the ink is increased from the second drive cycle Tc onward due to, for example, the influence of the residual vibration or the like caused by the ejection in the first drive cycle Tc, the boost pulse from the second drive cycle Tc onward can be omitted.

The multi-drop drive waveform (n≥3) of FIG. 10 with which printing with three or more gradations includes n basic drive waveforms arranged in the drive cycle Tc of one cycle. Although FIG. 10 illustrates the case of n=5 as an example, the same applies to the case in which n is any other number. The intermediate time Tm is provided between the drive waveform of the last n-th drop and the drive waveform of the (n−1)-th drop. The intermediate time Tm is set to, for example, 4AL or more. The intermediate time Tm is preferably 4AL to 8AL and is more preferably an even multiple of AL. The drive waveforms from the first drop to the (n−1)-th drop are continuous (back-to-back) without the intermediate time Tm. However, a delay time shorter than the intermediate time Tm may be provided between the drive waveforms.

Furthermore, immediately before the drive waveform of the last n-th drop, the boost pulse for increasing the ejection speed of the ink of the n-th drop is provided. In the drive waveform of the boost pulse, the voltage V1 is applied to the actuator 3 for the time TB. The pulse width (that is, the time TB) of the boost pulse is set to, for example, 0.2Ta to 0.5Ta. When the time Ta is AL, the time TB is 0.2AL to 0.5AL. With respect to the boost pulse, the interval between the midpoint (i.e., half of the time TB) of the pulse width and the midpoint (i.e., half of the time Ta) of the pulse width of the n-th drop of the expansion pulse is allowed to be the time Ta. In a case where the intermediate time Tm is set to, for example, 4AL to 8AL, it is preferable that the ejection speed of the ink of the n-th drop is, for example, 1.01 to 1.20 times the ejection speed of the ink of the first drop to the (n−1)-th drop. When n≥3, the boost pulse immediately before the first drop such as the case when n=2 may not be provided.

Subsequently, the ink ejection operation when the actuator 3 is driven with a signal having the multi-drop drive waveform will be described. As an example, FIG. 11 schematically illustrates a state of the ink droplets ejected with a multi-drop drive waveform (n=5) in which ink is ejected five times. It is noted that the operation of the actuator 3 according to the basic drive waveform included in the multi-drop drive waveform is as described above.

Figure 11A:
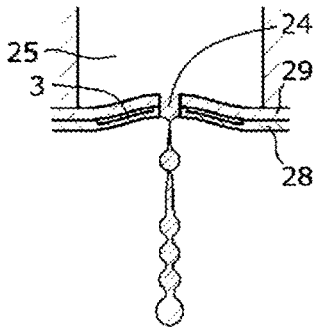
FIGS. 11A and 11B are diagrams illustrating a state of ink droplets ejected from an inkjet head.

That is, after the start of the drive cycle Tc, the ink of the first drop is ejected according to the drive waveform of the first drop. Subsequently, the ink of the second drop is ejected according to the drive waveform of the second drop. The ink droplets of the second drop are ejected in a state where the ink droplets of the first drop are still connected to the ink in the nozzle 25. After that, the ink of the third drop and the fourth drop is ejected in the similar manner. The ink of the last fifth drop is ejected with a delay of the intermediate time Tm. As schematically illustrated in FIG. 11A, the ink droplets from the first drop to the fifth drop are ejected in a state of being connected to each other through a liquid pillar, but the intermediate time Tm is provided, so that the liquid pillar formed between the ink droplet of the fifth drop and the ink in the nozzle 25 is thin. The amount of ink is approximately an amount of one drop of ink.

Figure 11B:
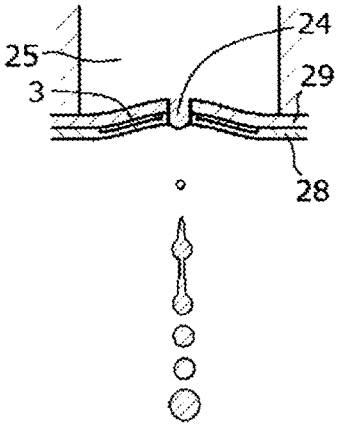

Then, as schematically illustrated in FIG. 11B, after the drive cycle Tc of this cycle elapses, the liquid pillar between the droplets of the fifth drop and the ink in the nozzle 24 is cut off. However, even though satellite droplets are generated, their sizes are small. Moreover, since the ink ejection speed of the fifth drop is increased, the flight speed of the satellite droplets is also high. Therefore, even though the satellite droplets are generated, due to their small droplet size, the flight speed is less likely to be decreased. That is, since the satellite droplets tails the main droplets at a higher speed, the landing disorder on the recording medium (i.e., the sheet S) is less likely to occur. For the ink droplets of the fifth drop, the delay caused by the intermediate time Tm is compensated by an increase in the ejection speed, and the landing disorder is less likely to occur.

Figure 12:
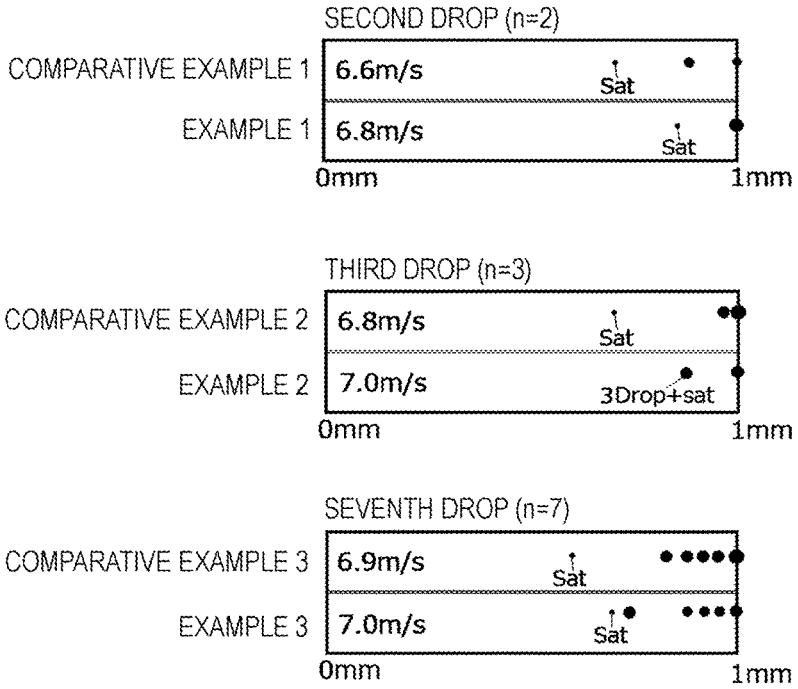
FIG. 12 is a diagram illustrating a result of an ink ejection test of an inkjet head.

FIG. 12 illustrates the imaging result of the actual ink ejection from the inkjet head 100 after a predetermined time (200 μs). FIG. 12 also illustrates the ejection speed calculated from the time at which all the droplets including the satellite droplets land on the sheet S. It is noted that the distance of 1 mm corresponds to a distance between the nozzle 24 and the sheet S. As a comparative example, the result when the ink is ejected with the multi-drop drive waveform without the intermediate time Tm and the boost pulse (TB) is also illustrated. As can be seen from Comparative Examples 1 to 3 shown in FIG. 12, all the two-drop (n=2), the three-drop (n=3) and the seven-drop (n=7) results show satellite droplets flying at a significantly slower speed with respect to the main droplets. On the other hand, in the cases of Examples 1 to 3, the delay of the satellite droplets with respect to the main droplets is small. Moreover, in Example 2 for three drops, the satellite droplets overlap the main droplets of the third drop. That is, the risk that the satellite droplets land at a position deviated from the main droplets is smaller in Examples 1 to 3. As described above, the ejection speed of the ink of the n-th drop is preferably 1.01 to 1.20 times the ejection speed of the ink of the first drop to the (n−1)-th drop. This is derived based on the result of FIG. 12 and the result of FIG. 17 described later. That is, if the ejection speed is not high, the satellite droplets lag behind the main droplets. On the other hand, if the ejection speed is too high, the ejection itself becomes unstable.

Figure 13:
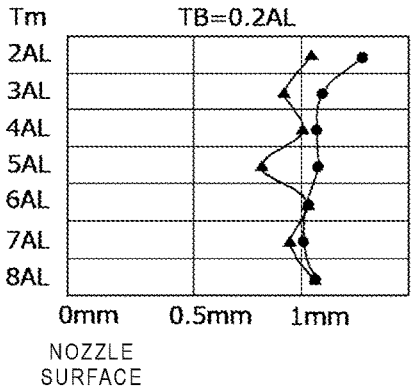
FIG. 13 is a diagram illustrating the result of an ink ejection test of an inkjet head.
Figure 13:
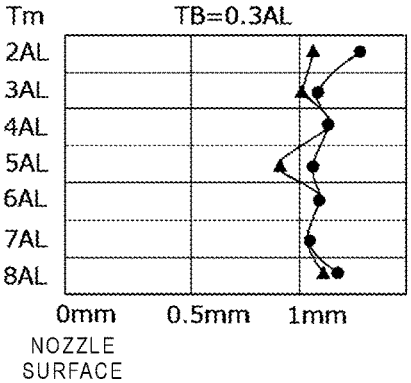

Furthermore, FIG. 13 illustrates the results of the ink ejection by changing the length of the intermediate time Tm of the multi-drop drive waveform (n=2). As can be seen from FIG. 13, when the intermediate time Tm is 4AL or more and is set to an even multiple of AL, the flight speed of the droplets of the satellite ink can be improved. The tendency does not change even though the time TB of the boost pulse is changed. However, it has been confirmed that, when the time TB of the boost pulse is set to a value exceeding 0.5AL, the ink ejection state of the second drop becomes unstable.

Second Embodiment

Subsequently, the inkjet head 100 according to a second embodiment will be described. The inkjet head 100 according to the second embodiment is the same as the inkjet head 100 according to the first embodiment except that the drive waveforms of the signal applied to the actuator 3 are different.

Figure 14:
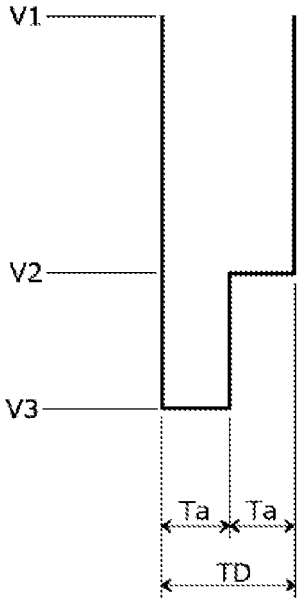
FIG. 14 illustrates a waveform of a drive signal to be input to an actuator of an inkjet head according to a second embodiment.

FIG. 14 illustrates the basic drive waveform for ejecting the ink once. The basic drive waveform is a pulling drive waveform, similar to the basic drive waveform of the first embodiment. When dots are formed by this one-drop ejection, the actuator 3 is driven with a signal having only a basic drive waveform. In a case of performing printing with two or more gradations, the actuator 3 is driven by a signal having the multi-drop drive waveform based on the basic drive waveform. A detailed description of the multi-drop drive waveform will be described later.

As illustrated in FIG. 14, in the basic drive waveform, the voltage V1 as the bias voltage is applied to the actuator 3. Then, after applying the voltage V3 as the expansion pulse to the actuator 3 for the time Ta, the voltage V2 as the contraction pulse for ejecting the ink is applied to the actuator 3 for the time Ta. Subsequently, as the contraction pulse for attenuating the residual vibration, the voltage V1 is applied to the actuator 3. The voltage V1 is, for example, three times the voltage V2. As an example, the voltage V1 is 22.5 V; the voltage V2 is 7.5 V; and the voltage V3 is 0 V. It is noted that the operation of the actuator 3 when the expansion pulse, the contraction pulse for ejecting the ink, and the contraction pulse for attenuating the residual vibration are applied is the same as that of the first embodiment.

Each pulse width (that is, the time Ta) is preferably set to AL. In a case where the time Ta is set to AL, the time TD of the basic drive waveform is 2AL. The time Ta of each pulse width may be a multiple of AL or may be shorter than AL. Furthermore, the times Ta of the pulse widths may be different from each other.

Figure 15:
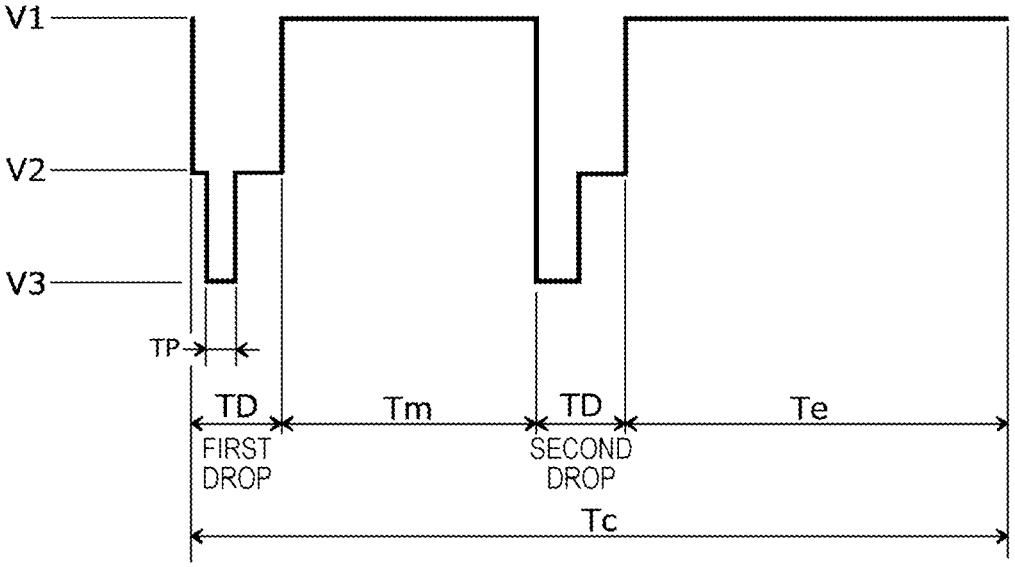
FIG. 15 illustrates a waveform of a multi-drop drive signal (n=2) to be input to the actuator.

As illustrated in FIG. 15, the multi-drop drive waveform (n=2) by which printing with two gradations is performed includes two basic drive waveforms arranged within one drive cycle Tc. At this time, the intermediate time Tm is provided between the drive waveform of the first drop and the drive waveform of the second drop. The intermediate time Tm is, for example, 8AL. The intermediate time Tm is preferably 4AL to 8AL and is more preferably an even multiple of AL. Furthermore, the pulse width of the expansion pulse of the second drop is larger than the pulse width of the expansion pulse of the first drop. Accordingly, the ejection speed of the ink of the second drop is higher than the ejection speed of the ink of the first drop. As an example, the pulse width of the expansion pulse of the first drop is set to 0.8 Ta, and the pulse width of the expansion pulse of the second drop is set to the time Ta. In a case where the time Ta is set to AL, the pulse widths of the first and second drips are 0.8AL and AL, respectively. In a case where the intermediate time Tm is, for example, 4AL to 8AL, it is preferable that the ejection speed of the ink of the second drop is, for example, 1.01 to 1.20 times the ejection speed of the ink of the first drop.

The expansion pulse of the first drop is applied to the actuator 3 after a time of 0.2Ta elapses from the start of the drive cycle Tc. That is, the end of the expansion pulse of the first drop is set to be the time Ta after the start of the drive cycle Tc. The contraction pulse for ejecting the ink is the time Ta for both the first drop and the second drop. Therefore, the time TD of the drive waveform of the first drop is the same as the time TD of the drive waveform of the second drop.

Figure 16:
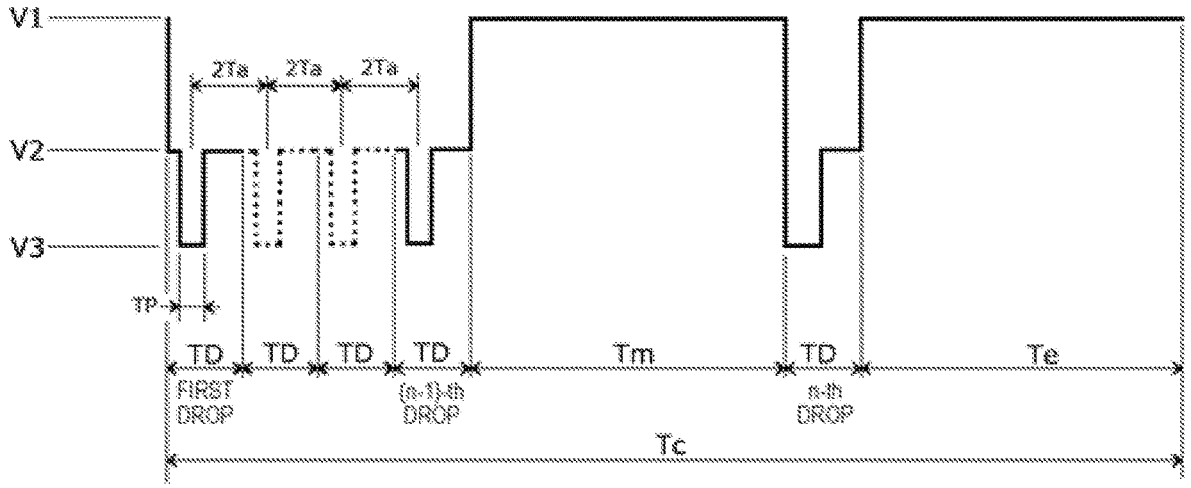
FIG. 16 illustrates a waveform of a multi-drop drive signal (n 3) to be input to the actuator.

As illustrated in FIG. 16, the multi-drop drive waveform (n≥3) with which printing with three or more gradations is performed includes n basic drive waveforms arranged in one drive cycle Tc. FIG. 16 illustrates the case of n=5 as an example, but the same applies to the cases where n is not 5. The intermediate time Tm is provided between the drive waveform of the last n-th drop and the drive waveform of the (n−1)-th drop. The intermediate time Tm is set to, for example, 8AL. The intermediate time Tm is preferably 4AL to 8AL and is more preferably an even multiple of AL. On the other hand, the drive waveforms from the first drop to the (n−1)-th drop are continuous (back-to-back) without providing the intermediate time Tm and the cancel pulse. However, a delay time shorter than the intermediate time Tm may be provided between the drive waveforms.

Furthermore, the pulse width of the expansion pulse for the last n-th drop is larger than the pulse width of the individual expansion pulse for the first drop to the (n−1)-th drop. Accordingly, the ejection speed of the ink for the n-th drop is increased compared with the ejection speed of the ink for the first drop to the (n−1)-th drop. As an example, the pulse width of the expansion pulse from the first drop to the (n−1)-th drop is set to 0.8 Ta, and the pulse width of the expansion pulse of the n-th drop is set to the time Ta. In a case where the time Ta is AL, those pulse widths are 0.8AL and AL. In a case where the intermediate time Tm is set to, for example, 4AL to 8AL, it is preferable that the ejection speed of the ink of the n-th drop is, for example, 1.01 to 1.20 times the ejection speed of the ink from the first drop to the (n−1)-th drop.

The expansion pulse of the first drop is applied to the actuator 3 after a time of 0.2Ta elapses from the start of the drive cycle Tc. That is, the end of the expansion pulse of the first drop is set to be at the time Ta after the start of the drive cycle Tc. The contraction pulse for ejecting the ink is the time Ta. The expansion pulse of the second drop is applied to the actuator 3 after the time of 0.2Ta elapses after the time Ta of the contraction pulse of the first drop elapses. That is, the interval between the midpoint of the expansion pulse of the first drop and the midpoint of the expansion pulse of the second drop is set to 2Ta. The same applies to the third and subsequent drops.

Figure 17:
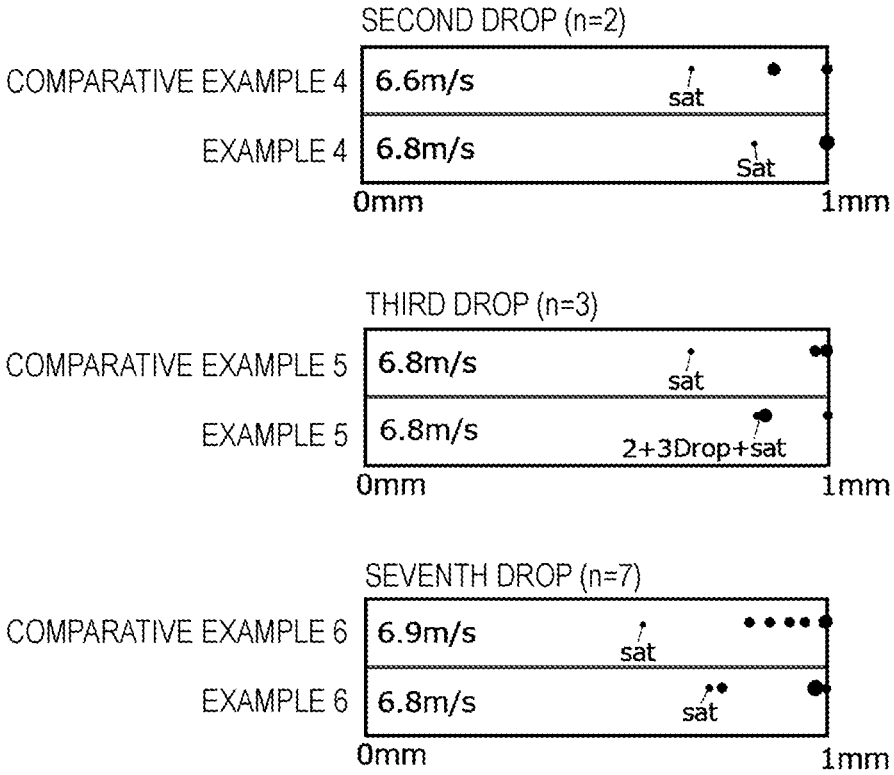
FIG. 17 is an explanatory view illustrating a result of an ink ejection test of an inkjet head.

FIG. 17 illustrates the imaging result of the actual ink ejection after a predetermined time (200 μs), similar to FIG. 12. As a comparative example, the result when the ink is ejected with the multi-drop drive waveform without providing the intermediate time Tm and the boost pulse (TB) are also illustrated. As can be seen from Comparative Examples 4 to 6 shown in FIG. 17, all the two-drop (n=2), the three-drop (n=3) and the seven-drop (n=7) results show satellite droplets flying at a significantly slower speed with respect to the main droplets. On the other hand, in the cases of Examples 4 to 6, the delay of the satellite droplets with respect to the main droplets is small, or the satellite droplets overlap (integrate with) the main droplets. That is, the risk that the satellite droplets land at a position on the recording medium distinctively deviated from the main droplets is smaller in Examples 4 to 6.

According to any of the above embodiments, when a signal having the aforementioned multi-drop drive waveform is applied to the actuator 3 to eject the ink for performing gradation printing or the like, the intermediate time Tm is provided between the drive waveform of the last n-th drop and the drive waveform of the (n−1)-th drop, so that the liquid pillar that may form between the ink droplet of the last n-th drop and the ink in the nozzle 24 can be thinned (reduced in amount or volume). As a result, even though satellite droplets are generated, those droplets can be smaller. Moreover, since the ejection speed of the ink of the last n-th drop is increased, the flying satellite droplets follows the main droplets with a small delay. As a result, it is possible to suppress deterioration of the printing quality due to landing disorder of the droplets of the satellite ink.

It is noted that, in the inkjet heads 100 to 103, both the actuator 3 and the nozzle 24 may not be necessarily arranged on the surface of the nozzle plate 2. For example, an inkjet head including an actuator of any drive type of a drop-on-demand piezo system, a share wall type, and a shear mode type may be used.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head, comprising:

a pressure chamber for storing ink;

a nozzle communicating with the pressure chamber;

an actuator configured to eject the ink through the nozzle by changing a volume of the pressure chamber; and an actuator drive circuit configured to output to the actuator a drive signal that has a drive waveform having a predetermined cycle based on a number of gradation levels being used for printing, wherein when printing is performed using three or more gradation levels, the drive circuit outputs the drive signal having a multi-drop drive waveform including:

two or more first waveforms for ejecting first to (n−1)-th droplets of the ink, where n is equal to or greater than 3, a second waveform for ejecting an n-th droplet of the ink, an intermediate time between the first waveform for ejecting the (n−1)-th droplet and the second waveform for ejecting the n-th droplet, the intermediate time being longer than a time between two of the first waveforms that are adjacent to each other, and a boost pulse by which a first voltage is applied to the actuator before the second waveform, wherein a second voltage lower than the first voltage is applied to the actuator before the boost pulse during the intermediate time, and the second waveform includes an expansion pulse following the boost pulse and by which a third voltage lower than the second voltage is applied to the actuator.

2. The inkjet head according to claim 1, wherein the second waveform further includes a cancel pulse following the expansion pulse and by which the first voltage is applied to the actuator.

3. The inkjet head according to claim 1, wherein a cycle of the second drive waveform is identical to a cycle of each of the first drive waveforms.

4. The inkjet head according to claim 1, wherein the intermediate time is equal to or greater than an acoustic length of the ink in the inkjet head multiplied by four.

5. The inkjet head according to claim 4, wherein the intermediate time is an even multiple of the acoustic length.

6. The inkjet head according to claim 1, wherein a pulse width of the expansion pulse for the second waveform is larger than a pulse width of an expansion pulse for each of the first waveforms.

7. An inkjet head, comprising:

a pressure chamber for storing ink;

a nozzle communicating with the pressure chamber;

an actuator configured to eject the ink through the nozzle by changing a volume of the pressure chamber; and an actuator drive circuit configured to output to the actuator a drive signal that has a drive waveform having a predetermined cycle based on a number of gradation levels being used for printing, wherein when printing is performed using three or more gradation levels, the drive circuit outputs the drive signal having a multi-drop drive waveform including:

two or more first waveforms for ejecting first to (n−1)-th droplets of the ink, where n is equal to or greater than 3, a second waveform for ejecting an n-th droplet of the ink, and an intermediate time between the first waveform for ejecting the (n−1)-th droplet and the second waveform for ejecting the n-th droplet, the intermediate time being longer than a time between two of the first waveforms that are adjacent to each other, wherein wherein a boost pulse by which a first voltage is applied to the actuator is applied in the intermediate time, a second voltage lower than the first voltage is applied to the actuator before the boost pulse, and the second waveform includes an expansion pulse following the boost pulse and by which a third voltage lower than the second voltage is applied to the actuator.

8. An inkjet printer, comprising:

an inkjet head including:

a pressure chamber for storing ink;

a nozzle communicating with the pressure chamber;

an actuator configured to eject the ink through the nozzle by changing a volume of the pressure chamber; and an actuator drive circuit configured to output to the actuator a drive signal that has a particular drive waveform having a predetermined cycle based on a number of gradation levels being used for printing, wherein when printing is performed using three or more gradation levels, the drive circuit outputs the drive signal having a multi-drop drive waveform including:

two or more first waveforms for ejecting first to (n−1)-th droplets, where n is equal to or greater than 3, a second waveform for ejecting an n-th droplet, an intermediate time between the first waveform for ejecting the (n−1-th droplet and the second waveform for ejecting the n-th droplet, the intermediate time being longer than a time between two of the first waveforms that are adjacent to each other, and a boost pulse by which a first voltage is applied to the actuator before the second waveform, wherein a second voltage lower than the first voltage is applied to the actuator before the boost pulse during the intermediate time, and the second waveform includes an expansion pulse following the boost pulse and by which a third voltage lower than the second voltage is applied to the actuator; and a control circuit configured to control the inkjet head to print an image on a sheet.

9. The inkjet printer according to claim 8, wherein the second waveform further includes a cancel pulse following the expansion pulse and by which the first voltage is applied to the actuator.

10. The inkjet printer according to claim 8, wherein a cycle of the second drive waveform is identical to a cycle of each of the first drive waveforms.

* * * * *